United States Patent [19]

Deutschmann

[11] 4,191,152

[45] Mar. 4, 1980

[54] MULTI-CYLINDER INTERNAL COMBUSTION ENGINE

[75] Inventor: Herbert Deutschmann, Friedrichshafen, Fed. Rep. of Germany

[73] Assignee: Motoren- und Turbinen-Union Friedrichshafen GmbH, Fed. Rep. of Germany

[21] Appl. No.: 840,179

[22] Filed: Oct. 7, 1977

[30] Foreign Application Priority Data

Oct. 26, 1976 [DE] Fed. Rep. of Germany ..... 2648411

[51] Int. Cl.[2] ..... F02B 11/02

[52] U.S. Cl. ..... 123/119 C; 123/179 R; 123/198 F

[58] Field of Search ..... 123/119 C, 179 F, 179 R, 123/198 DB, 198 F

[56] References Cited

U.S. PATENT DOCUMENTS

| | | | |
|---|---|---|---|
| 1,629,530 | 5/1927 | Reineke | 123/198 F |
| 2,236,634 | 4/1941 | Yamashita | 123/179 F |
| 3,270,724 | 9/1966 | Dolza | 123/198 F |
| 3,744,934 | 7/1973 | Ueno | 123/198 F |
| 3,756,205 | 9/1973 | Frost | 123/198 F |
| 3,958,900 | 5/1976 | Ueno | 123/198 F |
| 3,963,379 | 6/1976 | Ueno | 123/198 F |

*Primary Examiner*—Charles J. Myhre
*Assistant Examiner*—Andrew M. Dolinar
*Attorney, Agent, or Firm*—Craig and Antonelli

[57] ABSTRACT

A diesel internal combustion engine with several cylinder units each consisting of a piston and a cylinder, with a low compression ratio and with exhaust gas turbocharging, in which for purposes of starting, a number of the cylinder units operate as internal combustion engine and a number as compressor during the compression stroke; one compressor cylinder unit each is thereby coordinated to a corresponding engine cylinder unit, whereby the piston of compressor unit leads the piston of the engine cylinder unit to such an extent that the engine cylinder unit at the beginning of its compression stroke can be supercharged by the compressor cylinder unit; the cylinders of the two cylinder units are connected with each other by way of a line separate from the customary suction and exhaust gas lines, by way of a first valve controlled corresponding to the operating condition of the internal combustion engine and by way of a second valve which opens in the presence of the necessary supercharging pressure.

15 Claims, 3 Drawing Figures

MULTI-CYLINDER INTERNAL COMBUSTION ENGINE

The present invention relates to a diesel internal combustion engine with cylinder units consisting of several pistons and cylinders, with a low compression ratio and with exhaust gas turbocharging, in which, during a medium to full load operation of the internal combustion engine, the cylinder units operate as an engine and, for purposes of starting, a number of the cylinder units operate as engine and a number as compressor during the compression stroke.

It is the aim of the present invention to attain in engine cylinder units a compression sufficiently high for the ignition of the fuel to be injected with corresponding temperatures notwithstanding the low compression ratio.

A multi-cylinder injection internal combustion engine is known in the prior art (German Gebrauchsmuster 1,809,779) in which closure devices for re-routing the precompressed air are provided in the exhaust line of each of the cylinders producing the precompressed air, in the suction line of the cylinder operating as engine and in a common overflow channel. These closure devices have to be designed and dimensioned for the cross section of the suction and exhaust gas lines and are partly exposed to the hot exhaust gases during normal engine operation. As a result thereof, such closure devices are expensive and prone to troubles.

It is the aim of the present invention to enable a supercharging without any influence on the suction and exhaust gas channels in order to avoid the aforementioned disadvantages.

The underlying problems are solved according to the present invention in that one compressor cylinder unit is coordinated to each engine cylinder unit, whose piston leads so far with respect to the piston of the coordinated engine cylinder unit that the engine cylinder unit at the beginning of its compression stroke can be supercharged by the compressor cylinder unit and in that the cylinders of the two cylinder units are connected with each other by a line separate from the customary suction and exhaust lines and by way of a first valve controlled corresponding to the operating condition of the internal combustion engine and by way of a second valve opening in the presence of the requisite supercharging pressure.

The advantage with respect to the known constructions resides in that the line between the two cylinders can be constructed with very small cross section. As a result thereof, the resulting detrimental space between the cylinders and the valves for the control of the compressed air is also kept small and correspondingly small valves can be utilized which are not acted upon by the hot exhaust gases and therefore are not exposed to the high exhaust gas temperatures.

A simplification in the control can be achieved according to the present invention in that the first valve is actuated in unison with the fuel-closure or connection for the cylinders operating as compressor during start and partial load operation.

The second valve may advantageously be constructed as check valve and may be correspondingly actuated by the pressure of the compressed air or this valve is actuated by a cam shaft of the internal combustion engine in dependence on the position of the two pistons.

A favorable partial load operating behavior of the internal combustion engine is achieved in that the subdivision into cylinders operating as engine and as compressor with corresponding fuel supply or fuel disconnection is carried out not only during the starting but also during the partial load operation.

An unnecessary power loss is avoided in that additionally a third valve is arranged in the line between the two cylinder units, which during the suction stroke of the piston of the compressor unit that follows the supercharging, permits the inlet of fresh air into the cylinder of the compressor cylinder unit.

Accordingly, it is an object of the present invention to provide a multi-cylinder diesel internal combustion engine which avoids by simple means the aforementioned shortcomings and drawbacks encountered in the prior art.

Another object of the present invention resides in a multi-cylinder diesel internal combustion engine in which a sufficiently high compression with corresponding temperatures is achieved for the ignition of the fuel to be injected notwithstanding the relatively low compression ratio of the internal combustion engine.

A further object of the present invention resides in a multi-cylinder diesel internal combustion engine in which some cylinder units operate as engine units and some as supercharging compressor units during the starting and partial load operation of the engine, yet costly valves are eliminated.

Still a further object of the present invention resides in a multi-cylinder diesel internal combustion engine of the type described above which is characterized by reliable operation and slight proneness to trouble due to valve failures.

Still another object of the present invention resides in a multi-cylinder diesel internal combustion engine in which supercharging can be realized by simple means without having to change or otherwise influence the suction and exhaust gas channels of the engine.

Another object of the present invention resides in a multi-cylinder diesel internal combustion engine of the type described above in which the line between the two cylinders can be constructed of very small cross section and in which the space requirements for these lines and therewith also for the valves used therewith can be kept relatively small.

A further object of the present invention resides in a diesel internal combustion engine in which not only a simplification of the control can be achieved by extremely simple means but a favorable partial load operating behavior of the engine can be assured without unnecessary power loss.

These and other objects, features and advantages of the present invention will become more apparent from the following description when taken in connection with the accompanying drawing which shows, for purposes of illustration only, two embodiments in accordance with the present invention, and wherein.

Figure 1:
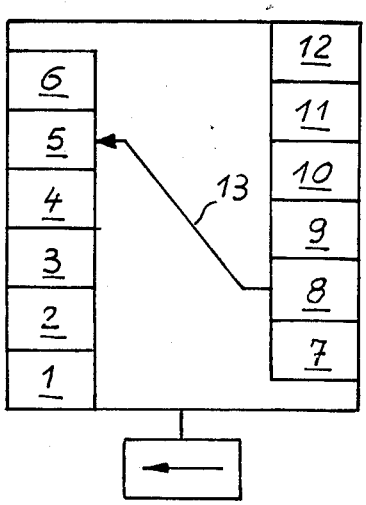
FIG. 1 is a schematic view of the arrangement of the cylinders of a four-cycle diesel internal combustion engine used in the present invention.

Referring now to the drawing wherein like reference numerals are used throughout the various views to designate like parts, a diesel internal combustion engine with twelve cylinders 1 through 12 arranged V-shaped in two rows is schematically illustrated in FIG. 1. The ignition sequence is 1-8-5-10-3-7-6-11-2-9-4-12. In the illustrated embodiment, the cylinders 1 to 6 of the first row are coordinated to the engine cylinder units while the cylinders 7 to 12 of the second row are coordinated to the compressor cylinder units. Consequently, the cylinders 8 and 5, 10 and 3, 7 and 6, 11 and 2, 9 and 4 and 12 and 1 are respectively connected with each other by means of lines. In FIG. 1, only the line between cylinder 8 and cylinder 5 is schematically illustrated and designated therein by reference numeral 13. Of course, it is also possible to subdivide only a part of the existing cylinders into engine and compressor cylinder units. Similarly, with a corresponding ignition sequence the two cylinder units belonging to each other may be arranged in the same row.

Figure 2:
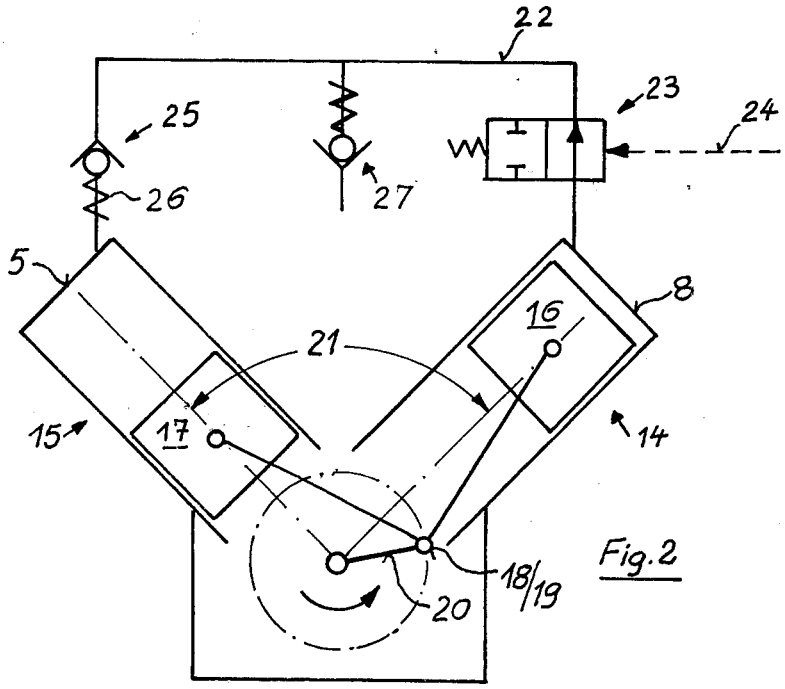
FIG. 2 is a schematic rear elevational view of a first embodiment of a compressor cylinder unit with associated engine cylinder unit in accordance with the present invention.

One compressor cylinder unit generally designated by reference numeral 14 having the cylinder 8 and a piston 16 as well as one engine cylinder unit generally designated by reference numeral 15 having the cylinder 5 and a piston 17 are illustrated in FIG. 2.

The location of the two crank pins 18/19 of a crankshaft indicated by reference numeral 20 coincides for both pistons 16 and 17. From the V angle 21 of the cylinder arrangement, which is illustrated in FIG. 2 with 90°, results a leading of the piston 16 of the compressor cylinder unit 14 of also 90° crankshaft angle with respect to the piston 17 of the engine cylinder unit 15. The piston 16 of the compressor cylinder unit 14 is illustrated in FIG. 2 in a position shortly before its upper dead-center position and has compressed the air quantity previously sucked-in by the same. The piston 17 of the engine cylinder unit 15 is illustrated in a position shortly after its lower dead-center position and therewith at the beginning of its compression stroke.

Figure 3:
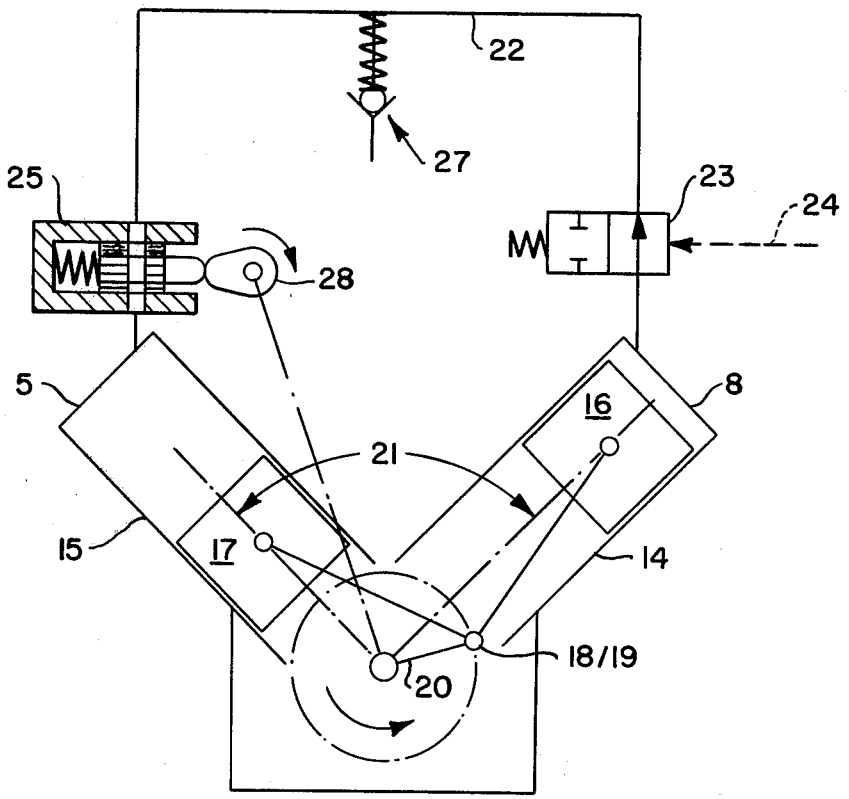
FIG. 3 is a schematic rear elevational view of another embodiment of a compressor cylinder unit with associated engine cylinder unit in accordance with the present invention.

According to the present invention, the two cylinders 8 and 5 are connected with each other by a line 22. The through-flow of this line 22 is controlled by a first valve generally designated by reference numeral 23 which is actuated during the starting and during partial load operation by way of a control line 24 in unison with a fuel closure valve (not shown) for the compressor cylinder units and therewith opens the line 22. Additionally, a second valve 25 is disposed in the line 22 which is opened against the force of a spring 26 by the pressure of the air compressed in the cylinder 8. The instant of the air transfer from the cylinder 8 to the cylinder 5 and the pressure magnitude during the compression beginning in the cylinder 5 can be determined by means of the design of this second valve 25. As shown in FIG. 3, the valve 25 may also be controlled by a cam 28 operatively connected with the crankshaft 20 of the internal combustion engine. The determination of the instant and pressure magnitude of the supercharging is thus also possible in dependence on the crankshaft angle and on the position of the piston.

Additionally, a third valve 27 may also be arranged in the line 22. This valve 27 prevents the occurrence of a larger vacuum in the line 22 when the piston 16 during the further rotation of the crankshaft passes through the upper dead-center position and after transfer of its compressed air quantity by way of the line 22 into the cylinder 5 and after closure of valve 25 carries out a suction stroke. The suction stroke which is carried out by the piston 16 in lieu of the working stroke would last without the valve 27 up to the opening of the exhaust valve of the cylinder 8 would produce a vacuum in the cylinder and would therefore require power.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

We claim:

1. A diesel internal combustion engine having a relatively low compression ratio and operating with exhaust gas turbocharging, the diesel internal combustion engine comprising several cylinder units each of which are operable as an engine during a medium to full load operation of the internal combustion engine, each cylinder unit including piston means and cylinder means, a number of the cylinder units operate as an engine and a number of the cylinder units operate as a compressor during a compression stroke of the piston means for the purpose of starting the internal combustion engine, characterized in that each compressor cylinder unit is coordinated to a respective engine cylinder unit, means are provided for connecting the piston means of the respective compressor cylinder units and the respective piston means of the engine cylinder unit to a crankshaft of the internal combustion engine so that the piston means of the respective compressor cylinder units lead the piston means of the coordinated engine cylinder unit whereby, at a beginning of a compression stroke of the respective engine cylinder unit, the coordinated compressor cylinder unit supercharges the engine cylinder unit, connecting means for communicating the cylinder means of the coordinated compressor and engine cylinder units with each other, and in that the connecting means includes a first valve means adapted to be controlled in correspondence with an operating condition of the internal combustion engine, and a second valve means adapted to be opened in the presence of a required supercharging pressure.

2. A diesel internal combustion engine with suction line means and exhaust gas line means according to claim 1, characterized in that said connecting means includes a line separate from the suction line means and exhaust gas line means arranged between each of the coordinated compressor and engine cylinder units.

3. A diesel internal combustion engine according to claim 2, characterized in that the operating condition of the internal combustion engine is a closure of a fuel supply valve, and in that means are provided for actuating the first valve means in response to the closure of the fuel supply valve so as to communicate the compressor cylinder units with the coordinated engine cylinder units during a starting operation of the internal combustion engine.

4. A diesel internal combustion engine according to claim 3, characterized in that the second valve means is constructed as check valve and is adapted to be actuated by pressure of the compressed air in the connecting means.

5. A diesel internal combustion engine according to claim 3, said engine including a cam shaft, characterized in that the second valve means is actuated by the cam shaft of the internal combustion engine.

6. A diesel internal combustion engine according to claim 3, characterized in that division of the cylinder units into engine units and compressor cylinder units, by a corresponding control of the fuel supply valve, is maintained not only during the starting operation of the internal combustion engine but also during a partial load operation of the internal combustion engine.

7. A diesel internal combustion engine according to claim 1, characterized in that division of the cylinder units into engine units and compressor cylinder units, by a corresponding control of the fuel supply valve, is maintained not only during the starting operation of the internal combustion engine but also during a partial load operation of the internal combustion engine.

8. A diesel internal combustion engine according to claim 1, characterized in that the second valve means is constructed as check valve and is adapted to be actuated by the pressure of the compressed air in the connecting means.

9. A diesel internal combustion engine according to claim 1, said engine including a cam shaft, characterized in that the second valve means is actuated by the cam shaft of the internal combustion engine.

10. A diesel internal combustion engine according to claim 1, characterized in that the operating condition of the internal combustion engine is a closure of a fuel supply valve, and in that means are provided for actuating the first valve means in response to the closure of the fuel supply valve so as to communicate the compressor cylinder units with the coordinated engine cylinder units during a starting operation of the internal combustion engine.

11. A diesel internal combustion engine according to claim 1, characterized in that the connecting means includes a third valve means interposed between coordinated compressor and engine cylinder units for permitting a supply of fresh air into the cylinder means of the respective compressor cylinder units during a suction stroke following a supercharging of the coordinated engine cylinder unit.

12. A diesel internal combustion engine having a relatively low compression ratio and operating with exhaust gas turbocharging, the diesel internal combustion engine comprising suction line means and exhaust gas line means, several cylinder units each of which are operable as an engine during a medium to full load operation of the internal combustion engine, each cylinder unit including piston means and cylinder means, a number of the cylinder units operating as an engine and a number of the cylinder units operating as a compressor during a compression stroke of the piston means, characterized in that each compressor cylinder unit is coordinated to a respective engine cylinder unit, the piston means of the respective compressor cylinder units leading the respective piston means of the coordinated engine cylinder unit so that the engine cylinder unit, at a beginning of a compression stroke, can be supercharged by the coordinated compressor cylinder unit, connecting means for connecting the cylinder means of the coordinated compressor and engine cylinder units with each other, the connecting means including a line separate from the suction line means and exhaust gas line means arranged between each of the coordinated compressor and engine cylinder units, a first valve means adapted to be controlled in correspondence with an operating condition of the internal combustion engine, the first valve means being actuated in unison with a closure of a fuel supply valve so as to connect the compressor cylinder units with the coordinated engine cylinder units during a starting operation of the internal combustion engine, a second valve means adapted to be opened in the presence of a required super-charging pressure, and a third valve means arranged in the line between the coordinated compressor and engine cylinder units for permitting a supply of fresh air into the cylinder means of the respective compressor cylinder units during a suction stroke following a supercharging of the coordinated engine cylinder unit, and in that the division of the cylinder units into engine cylinder units and compressor cylinder units, by a corresponding control of the fuel supply valve, is maintained not only during a starting operation of the internal combustion engine but also during a partial load operation of the internal combustion engine.

13. A diesel internal combustion engine according to claim 12, characterized in that the second valve means is constructed as check valve and is adapted to be actuated by the pressure of the compressed air in the connecting move.

14. A diesel internal combustion engine according to claim 12, said engine including a cam shaft, characterized in that the second valve means is actuated by the cam shaft of the internal combustion engine.

15. A diesel internal combustion engine having a relatively low compression ratio and operating with an exhaust gas turbocharging, the diesel internal combustion engine comprising suction line means and exhaust gas line means, several cylinder units each of which are operable as an engine during a medium to full load operation of the internal combustion engine, each cylinder unit including piston means and cylinder means, a number of cylinder units operate as an engine and a number of the cylinder units operate as a compressor during a compression stroke of the piston means for the purposes of starting the internal combustion engine, characterized in that each compressor cylinder unit is coordinated to a respective engine cylinder unit, the piston means of the respective compressor cylinder units leading the respective piston means of the engine cylinder unit so that the engine cylinder unit, at a beginning of a compression stroke, can be supercharged by the coordinated compressor cylinder unit, and in that connecting means are provided for connecting the cylinder means of the coordinated compressor and engine cylinder units with each other, the connecting means includes a line separate from the suction line means and exhaust gas line means arranged between each of the coordinated compressor and engine cylinder units, a first valve means adapted to be controlled in correspondence with an operating condition of the internal combustion engine, a second valve means adapted to be opened in the presence of a required supercharging pressure, and a third valve means arranged in the line between the coordinated compressor and engine cylinder units for permitting a supply of fresh air into the cylinder means of the respective compressor cylinder units during a suction stroke following a supercharging of the coordinated engine cylinder unit.

* * * * *